United States Patent [19]

Weigl et al.

[11] 4,266,133

[45] May 5, 1981

[54] MULTIPLE FOCUS X-RAY GENERATOR

[75] Inventors: Walter Weigl, Edison; Ulf Bergman, Iselin; Lennart Baum, Edison, all of N.J.

[73] Assignee: Siemens Corporation, Iselin, N.J.

[21] Appl. No.: 92,285

[22] Filed: Nov. 8, 1979

[51] Int. Cl.[3] ..... H05G 1/30

[52] U.S. Cl. ..... 250/402; 250/413

[58] Field of Search ..... 250/401, 402, 413, 408, 250/409; 313/56

[56] References Cited

U.S. PATENT DOCUMENTS

| | | | |
|---|---|---|---|
| 3,110,810 | 11/1963 | Fransen | 250/413 |
| 3,389,253 | 6/1968 | Kok | 313/56 |
| 3,946,261 | 3/1976 | Holland | 313/56 |

*Primary Examiner*—Craig E. Church

*Attorney, Agent, or Firm*—Spellman, Joel & Pelton

[57] ABSTRACT

An X-ray generator has at least a first and a second cathode filament for emitting electrons, one end of the first filament being connected to one end of the second filament, the connection point forming a terminal. Still two further terminals are located at the ends of the serial connection of the two filaments. Two of the three terminals are connected via a diode in each connection line to the first pole of a d-c source, while the third terminal is coupled to the second pole of the d-c source. Both diodes are oppositely poled. The polarity of the d-c voltage supplied by the d-c source can be changed, for example, by a remote reversing switch. The polarity of the d-c source determines which and how many filaments are energized to provide focal spots of different size. Since two supply lines are sufficient in a high-voltage cable for feeding the first and second filaments, a third line in the cable can be used for the supply of a third heating filament. This third filament may be coupled to one of the three terminals. Thus a triple focus X-ray generator which requires only three supply lines can be obtained. Also quadruple and higher focus X-ray generators may be obtained.

12 Claims, 5 Drawing Figures

MULTIPLE FOCUS X-RAY GENERATOR

BACKGROUND OF THE INVENTION

1. Field of the Invention

This invention relates to a novel and improved X-ray generator and in particular to an X-ray generator which contains more than one cathode heating filament which, when energized, emits electrons. More particularly, this invention relates to an X-ray generator, which contains several cathode heating filaments, at least some of which are electrically controllable independently from the others. Such an X-ray generator may be used in the medical field for diagnostic purposes.

2. Description of the Prior Art

A multi-focal X-ray generator, the X-ray tube of which contains several independently controllable heating cathodes, is known in the art, e.g. from the German Pat. No. 406,067. In one embodiment of the known generator, the cathode heating filaments may be supplied by separate heating current sources. In another embodiment, two cathode filaments are serially connected, and there is provided a switch via which either one or the other cathode filament may be supplied from a common heating current source. Most commonly a-c sources are used. When energized, a cathode filament emits electrons. Under the influence of a high-voltage, these electrons are accelerated and directed to an anode, where they give rise to the emission of X-rays. The geometry of the cathodes and the heating current intensity are such that on the anode there are created focal points or focal spots which have different sizes, with regard to each other.

In an X-ray tube for an X-ray generator of this type, two electrical supply lines are required for the first cathode filament, and an additional supply line is required for each additional heating filament. For instance, to control independently two focal spots, three supply lines are necessary. With increasing number of cathode filaments, this requires high-voltage installations, in particular high-voltage supply lines and cables, of increasingly difficult performance.

For this reason, for instance in the medical field diagnostic X-ray devices are known which have as a rule a maximum of two independently controllable focal points.

In U.S. Pat. No. 3,649,861, for instance, there is disclosed a double focus X-ray tube, the cathode of which provides alternatingly a large and a small focal spot upon an anode. The cathode head contains a pair of substantially parallel electron focusing recesses in each of which is mounted a filament. The recesses are focused such that when the entire length of each filament is energized, focal spots of equal length are imposed upon the anode in side-by-side relation so as to create a unitary rectangular focal spot having an overall width of about two millimeters. One of the filaments is electrically connected so as to permit energization of only one-half its length independently of the energization of the other filament, whereby a single focal spot one millimeter in width may be imposed upon the anode. This X-ray generator also requires three supply lines leading to two cathode filaments to independently control two different focal spots.

Hence, in conventional X-ray generators for diagnostic purposes, one is usually limited to the use of an X-ray generator having only two focal spots in order to be able to get along with a minimum of supply lines in the high-voltage installations, particularly in the high-voltage cables feeding the X-ray tube of the generator. It would, however, be desirable to provide an X-ray generator which, for example, requires only two supply lines for two cathode heating filaments. A third supply line could then be used to energize independently a third cathode filament and thus generate a third focal spot of different size.

SUMMARY OF THE INVENTION

An object of this invention is to provide an X-ray generator, which contains at least two cathode filaments which can be heated for the emission of electrons.

Another object of this invention is to provide an X-ray generator, which contains at least two cathode filaments, at least one of which can be individually switched on and off and heated for the emission of electrons.

Still another object of the invention is to provide an X-ray generator which generates on an anode at least two focal spots of different size.

Still another object of the invention is to provide an X-ray generator, which contains at least two cathode filaments which either separately or jointly can be switched on and off for the emission of electrons by remote control.

Still another object of the invention is to provide a multiple focus X-ray generator which suffices with few supply lines leading to its X-ray tube.

Still another object of the invention is to provide a double focus X-ray generator, which suffices with only two supply lines for separately energizing and controlling two focal spots.

Still another object of the invention is to provide a triple focus X-ray generator, which suffices with three supply lines for the separate generation and control of three focal spots.

Still another object of this invention is to provide an X-ray generator, the X-ray tube of which is a trifocal tube, in which an ordinary supply cable for a double focus tube can be used.

Still another object of this invention is to provide an X-ray generator, the X-ray tube of which is a triple focus tube, in which can be used an energy supply cable with four lines, the first three lines of which may be used for the individual control of three focal spots and the fourth line of which may be used for electrically focusing the width of the focal spot by applying a focusing voltage, whereby one of the first three lines may be used simultaneously to apply the anode-cathode voltage between the cathode and an anode.

Still another object of the invention is to provide a multiple focus X-ray generator, which suffices with only two supply lines for the individual generation of two different focal spots, whereby both focal spots shall have different widths without using an electric device for width focusing.

Still another object of the invention is to provide a multiple focus X-ray generator, which comprises at least one tapped heating filament with two sections, which sections shall be energized either separately or jointly.

Still another object of the invention is to provide a multiple focus X-ray generator, which comprises at least two serial connected coils which are arranged on an a cathode used in a parallel arrangement.

Still another object of the invention is to provide at least a quadruple X-ray generator, which comprises at least four heating filaments that may be controlled independently from each other and which suffices with only four heating lines for the independent control of four focal spots.

The multiple focus X-ray generator according to this invention comprises an X-ray tube having as an electron source at least a first and a second cathode filament, heating filament or heating coil. These filaments are either two different filaments or the two sections of a tapped heating coil. One end of each of the first and second filaments are connected together to a first connecting point to form a serial connection. There are three terminals associated with this serial connection: two of these terminals are formed by the outer ends of the serial connection, and one of these terminals is formed by the connection point of the filaments. The generator further comprises two diodes, each of which has two electrodes, i.e. an anode and a cathode. Each diode is coupled with one of its electrodes to one of the three terminals and with the other of its electrodes to a common second connection point. Looking at the second connection point, the diodes are poled in opposite direction; i.e., one is connected to that point with its anode and the other with its cathode. The generator also comprises a d-c supply having a positive pole and a negative pole. One of these poles is connected to the second connection point of the diodes, and the other is connected to the third of the terminals. The d-c supply includes a switching device to change the polarity of its d-c voltage. The polarity of the d-c voltage determines which of the filament(s) is/are energized, and thus which focal spot is selected.

According to the invention, by using oppositely poled diodes, it is possible to select the filament(s) which shall be heated, depending upon the polarity of the applied heating voltage. Only two lines leading over a high voltage cable are required to control the first and second cathode filaments.

The reversing switch, which may be provided for changing the polarity of the d-c voltage, may be housed in the apparatus which applies a high voltage to the anode-cathode arrangement of the X-ray tube. The diodes may be arranged directly next to the X-ray tube in a protective housing provided for the X-ray tube.

According to another embodiment of the invention, a pair of heating filaments or a pair of sections of a heating coil may also be provided in a multiple form, in order to reduce the number of lines for a multifocal tube.

The effect of the electric circuit including the diodes is this: When the heating current is poled in one direction due to the use of diodes and to the state or position of the switching device, only one of the two serial-connected cathode filaments is traversed by d-c current and heated. This filament will then emit electrons, as soon as a certain current intensity is reached. Provided a high voltage is applied to the anode-cathode arrangement of the X-ray tube, the electrons are attracted by the anode where they cause emission of X-rays. It is essentially the geometry of the heated filament which determines the size of the focal point on the anode. In a reversal of the switching device, the direction of the heating current is reversed. Now, according to one embodiment of the invention, either the other filament or, according to another embodiment of the invention, both filaments are traversed by the heating current. Then the other filament, or both filaments jointly, essentially determine the size of the focal point.

If two separate cathode filaments are used instead of a subdivision of a heating coil into two sections, according to still another embodiment of the invention, the filaments may have different sizes. The wire thickness and/or the winding distances are preferably selected different from each other. Thus the electric resistance per unit length may be different. The selection may be such that, under a certain heating current, only one of the two filaments attains the temperature necessary for the emission of electrons and produces a first focal point. After reversal of the direction of the heating current, only the other filament, which is laid out for a higher heating current, is heated up to emit electrons, which produce a second focal point corresponding to the size of this filament. In a special embodiment, a wire width thickness of 0.3 mm may be selected for the first filament, and a wire width thickness of 0.2 mm may be chosen for the second filament.

To obtain a tri-focal X-ray tube, there may be added a third cathode filament. This third filament may have a greater length than the combination of the first and the second filament, and it may be heated by an a-c current. The wire for the added longer third heating filament may have a diameter of for instance 0.22 mm.

According to still another embodiment, one diode is connected to one end and the other diode is connected to the other end of the serial connection of the first and second filaments. One pole of the d-c supply is connected to the second connection point of the two diodes, and the other pole is connected to the connection point of the filaments. Depending on the polarity of the d-c supply, either the first or the second filament is heated. In this embodiment, the two heating filaments preferably are of different size.

Still other embodiments are subject of the claims.

BRIEF DESCRIPTION OF THE DRAWINGS

The foregoing and other objects, features and advantages of the invention will be apparent from the following more particular description of preferred embodiments of the invention, as illustrated in the accompanying drawings.

In the drawings.

DESCRIPTION OF THE PREFERRED EMBODIMENTS

Figure 1:
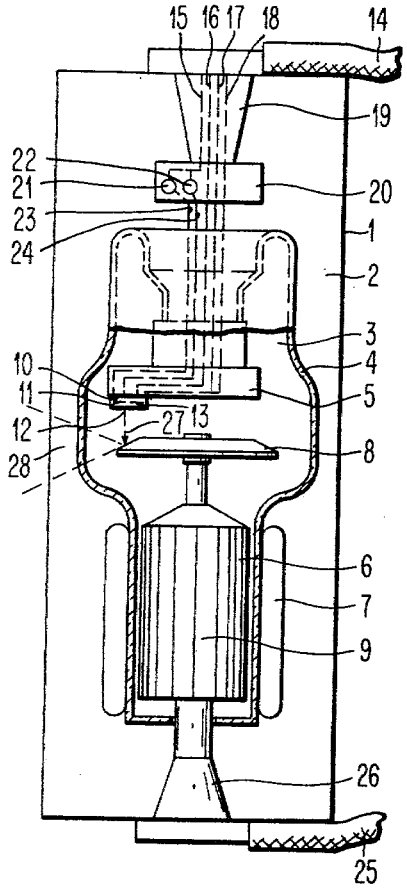
FIG. 1 is a general view of a multiple focus X-ray generator according to the invention, including a partly broken away X-ray tube and its wiring.

In FIG. 1 a triple focus X-ray generator is shown which may be used in a diagnostic X-ray device, for instance for the purpose of angiography. The generator comprises a protective tube housing 1, in the oil-filled interior 2 of which is mounted an X-ray tube 3. The X-ray tube 3 consists in known manner of a vacuum bulb 4, on the inner end wall of which is secured a cathode arrangement 5 and, opposite to it, an anode arrangement 6. On the outside of the X-ray tube 3 are arranged in the range of anode arrangement 6 coils 7 for driving a rotating anode 8. Rotation is effected in a known manner by a rotor 9. Three heating coils or cathode filaments are arranged in a cap or cathode head 10 on cathode arrangement 5. They serve as electron sources. These three cathode filaments are designated schematically in FIG. 1 with reference numerals 11, 12 and 13. The first and second filaments 11 and 12, respectively, are either sections of a tapped heating coil (see FIGS. 2 and 5) or two separate filaments connected in a serial relationship (see FIGS. 3 and 4).

Cathode arrangement 5 is supplied with electrical energy via a first high-voltage cable 14. Cable 14 includes four supply lines 15, 16, 17 and 18. These supply lines 15 to 18 are shown in FIG. 1 by broken lines. Cable 14 may be a cable which is commonly used as an energy supply cable in connection with a double focus X-ray device. The supply lines 15 to 18 are introduced into the tube housing 1 over a first plug 19. The plug 19 is connected to a connection plate 20 in which or on which are arranged two diodes 21 and 22. The first diode 21 is connected with its one pole to line 15, and the second diode 22 is connected with its opposite pole to the same line 15. The other pole of the first diode 21 is connected over a line 23 to one end of the first heating filament 11, and the second diode 22 is connected with its free end over a line 24 to one end of the second heating filament 12. The supply line 16 leads to the free end or ends of heating filaments 11 and 12, and the supply line 17 leads to an end of the third heating filament 13.

A high voltage sufficient to accelerate electrons for generating X-rays is applied between anode arrangement 8 and cathode arrangement 10. The high voltage is supplied to the cathode arrangement 5 by first cable 14 and first plug 19 and to anode arrangement 8 by a second high voltage cable 25 and a second plug 26. The high voltage arrives from a known voltage generating apparatus (shown in FIG. 2 as block 44).

The operation of the X-ray generator according to FIG. 1 is based on known principles. When a heating voltage is applied to one or more of the cathode filaments 11, 12 and 13 and when a high voltage is applied, e.g. 30 to 150 kV, between at least one of the heating filaments 11 to 13 and rotating anode 8 over cables 14 and 25, an electron beam 27 is directed to the rotating anode 8 so that an X-ray cone 28 is emitted therefrom.

Figure 2:
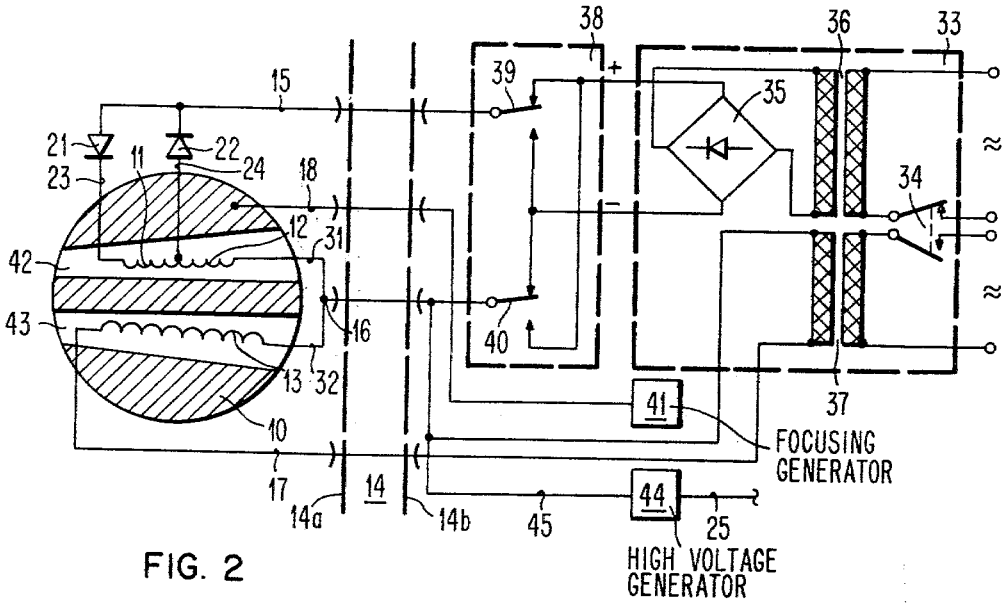
FIG. 2 is a top view of a cathode arrangement of an X-ray generator according to the invention, together with an electric circuit including two diodes, a reversing switch and a d-c electrical supply.

Turning now to FIG. 2, the electric connections of filaments 11 to 13 and diodes 21, 22 are shown in more detail. Both heating filaments 11 and 12 are shown to be the two sections of a tapped heating coil. This may be termed a serial connection and the tap may be called a first connection point. Filaments 11 and 12 may have different lengths; in this embodiment, however, they have preferably approximately the same length. As can be seen from FIG. 2, the tapped coil 11, 12 is in total shorter than the third filament 13. The three heating filaments 11, 12 and 13 in FIG. 2 represent the electron sources of a triple focus X-ray generator.

The embodiment of FIG. 2 shows that the first diode 21 is connected to the left outer end of combined filaments 11, 12 and that the second diode 22 is connected to the connection point of combined filaments 11, 12. Anode of diode 21 and cathode of diode 22 are both connected to a second connection point, which in turn is connected to line 15. The right outer end of the combined filaments 11, 12 is connected to the third heating filament 13. Thus, there is a serial connection of all three filaments 11 to 13. The connection lines between filament combination 11, 12 on the one hand and third filament 13 on the other hand are denoted by 31 and 32. Lines 31 and 32 are both connected to line 16.

The supply of heating filaments 11 to 13 with heating current is effected by a heating current generator 33. This generator 33 supplies either a d-c current to first and/or second filaments 11, 12, or an a-c heating current to third filament 13. Whether a d-c or a-c heating current will flow is determined by the position of a switch 34.

The d-c current is delivered from a rectifier 35 which is fed over a transformer 36 by an a-c voltage source. The a-c current is delivered by a transformer 37 which is also fed by an a-c voltage source. The switch 34 is a double switch which is connected in the connection lines to the primaries of transformers 36 and 37. Either one or the other transformer 36, 37 is energized. The d-c output of generator 33 is coupled to the cathode arrangement 5 over a reversing switch 38 and the lines 15 and 16 of high voltage cable 14. The a-c output of generator 33 is coupled to the third filament 13 over wires 16 and 17 of cable 14. The cable 14 which includes only four connection lines, is indicated in FIG. 2 by two broken lines 14*a* and 14*b*.

An essential part of the X-ray generator is the reversing switch 38. This reversing switch may be either a mechanical or an electric switch. It may be arranged preferrably in the housing of the generator 33, or in the housing of a high voltage generator which supplies the X-ray tube 3. The reversing switch 38, which has two arms 39 and 40, makes possible remote focus control. The switching arms 39 and 40 serve to change the polarity of the d-c voltage arriving from the heating current generator 33. Thus, the d-c voltage can be supplied to lines 15 and 16 in either polarity.

Line 18, which is connected to cathode head 10, is supplied by a bias or focusing generator 41. The bias voltage supplied from the bias generator 41 serves in a known manner to focus the electrons which are emitted from filaments 11 to 13. The bias voltage controls the width of the focal spots on the anodes. It may also control the bias of a grid of X-ray tube 3. As can be seen from FIG. 2, the cathode head 10 contains two grooves 42 and 43 which extend from one side to the other approximately in parallel. Heater filaments 11 and 12 are arranged in groove 42, and the third heater filament 13 is arranged in groove 43. Each of the filaments 11 to 13 is well insulated from the cathode head 10.

A high-voltage generator 44 applies a high voltage between cathode and anode. The voltage is fed via line 45, line 16 of cable 14 to the connection point of filaments 12 and 13 and via the cable 25 and the plug 26 to the anode 8.

The operation of the X-ray generator regarding the heating of the filaments 11 to 13 will now be described. Assume that switches 34 and 38 are in the positions shown in FIG. 2. Thus, only transformer 36 is energized. The positions of these switches 34 and 39 determine the size of the focal spot on the anode 8 and thus the quantity of the emitted X-rays.

In the first switching position of reversing switch 38, which is shown in FIG. 2, heating filaments 11 and 12 are jointly heated. D-c current flows from the positive output terminal of generator 33 over contact arm 39, line 15, first diode 21, filaments 11 and 12, line 16 and contact arm 40 to the negative output terminal of generator 33. Note that in this switching position first diode 22 is poled in blocking direction. The length and the width of the focal spot generated on the anode 8 are determined by the size of both filaments 11 and 12. Now if the reversing switch 38 is switched into its other position, the length of the electron-emitting surface and thus the length of the X-ray focal point formed on the anode 8 will be shortened. In this case only the second filament 12 is heated. D-c heating current is flowing from the positive pole of the generator 33 over contact arm 40, line 16, line 31, filament 12, diode 22, line 15, contact arm 39 to the negative pole of generator 33. Note, that in this second position of reversing switch 38, the first diode 21 is poled in blocking direction. The length and width of the focal spot on the anode 8 are now determined by the second filament 12.

In order to reduce the width of the X-ray focal point in the second position of reversing switch 38, the negative bias voltage, applied over connection line 18 to cathode head 10, must be adjusted. The bias compresses electrostatically the electron beam emitted from the second heating filament 12 and thus serves to focus the electrons. Therefore, the area on the anode 8, which is exposed to electrons, can be made much smaller than in the first switching position of reversing switch 38.

If switch 34 is switched into its other position than shown in FIG. 2, filaments 11 and 12 are out of operation, and the third filament 13 is energized by an a.c. current from the second transformer 37. Since the third filament 13 is longer than the length of the combined filaments 11 and 12, the focal length is longer, thus giving rise to a greater emission of X-rays.

It should be pointed out again that an X-ray generator according to FIG. 2 permits establishment of three different focuses. These three focuses can be established separately. It should be noted especially that for such a triple focus X-ray device a high voltage cable 14 containing only four lines 15 to 18 is required.

Figure 3:
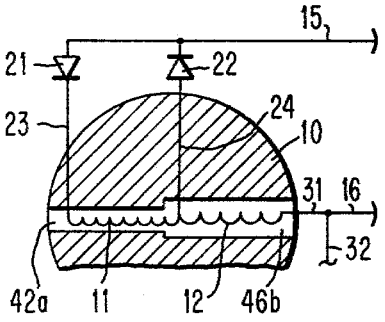
FIG. 3 is a top view of a cathode arrangement including diodes which can be used instead of that one shown in FIG. 2.

FIG. 3 represents another embodiment of the invention. The circuit in FIG. 3 may replace the arrangement of the elements 11, 12, 21 and 22 of FIG. 2. The embodiment according to FIG. 3 uses tungsten wires of different thicknesses as heating filaments 11 and 12, which are connected together in a first connection point. The first heating filament 11 is made of a thinner wire than the second heating filament 12, and the heating filament 11 may be wound with a tighter winding distance than heating coil 12. The term "winding distance" is intended to mean the distance between two adjacent windings of the filament. The filaments 11 and 12 then have different electric resistance per unit length.

Two groove sections **42*a* and 42*b* are provided, corresponding in diameter to the diameter of the heating filaments 11 and 12. These groove sections 42*a* and 42*b* thus have different sizes. Groove 42*a* is smaller in width than groove 42*b*. The length of both heating filaments 11 and 12 should be different; filament 12 should be longer than filament 11. Both heating filaments are arranged in a side by side position. The first filament 11 may consist, for instance, of tungsten wire of 0.2 mm thickness and may be wound with a winding distance of 0.02 mm. In heating coil 12 a tungsten wire of, for instance, 0.3 mm thickness with a winding distance of 0.2 mm may be used. In the third heating filament 13, which is not shown in FIG. 3**, a tungsten wire of the ordinary thickness of 0.22 mm may be applied.

Because of the use of wires of different thickness and of filaments 11 and 12 of different winding distance, both heating filaments 11 and 12 are simultaneously traversed by d-c current when the d-c voltage of generator 33 is poled in forward direction of diode 21 by reversing switch 38. Below a certain current intensity, however, only first filament 11, which is wound closer and of thinner wire than second filament 12, attains a temperature sufficient for the emission of electrons. In this first position of the reversing switch 38, heating filament 11 determines by its dimensions and by the shape of focusing groove section **42*a* in this current range the dimensions of the X-ray focal point on the anode 8. When the reversing switch 38 is switched to its second position, the first diode 21 is operated in blocking direction and the second diode 22 in forward direction. With a d-c heating current above a certain intensity, now the second heating filament 12 attains a temperature that is sufficient for the emission of electrons. Geometry of heating coil 12 and of the focusing groove section 42*b* then determine the dimensions of the X-ray focal point of anode 8**.

It should also be mentioned that the focal point which is generated by the first heating filament 11 is smaller than the focal point which is generated by the second heating filament 12. Changing the polarity of the voltage between lines 15 and 16, which can easily be performed by the reversing switch 38, causes widening or narrowing of the focal point. Simultaneously the length of the focal point is affected. A focusing generator 41 is not needed.

Line 18 in cable 14 can therefore be used for other purposes.

Figure 4:
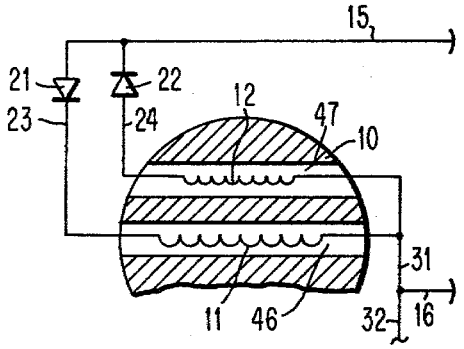
FIG. 4 is a top view of another cathode arrangement including diodes which can be used instead of that one shown in FIG. 2.

FIG. 4 shows still another embodiment of the invention. The cathode arrangement of FIG. 4 may also substitute the cathode arrangement shown in FIG. 2. In this embodiment, two serial connected heating filaments 11 and 12 of different length are used. They may also have different wire thickness and different winding distance. Heating coils 11 and 12 are arranged in parallel grooves 46 and 47, respectively. The connection point of filaments 11 and 12 is coupled over line 31 and line 16 to one of the poles of the d-c supply source. The free end of the first filament 11 is coupled via connection line 23 and diode 21 to a second connection point, and the free end of second filament 12 is connected via connection line 24 and diode 22 to the same connection point. Thus anode of diode 21 and cathode of diode 22 are both coupled via line 15 to the other pole of the d-c supply source.

Depending on the position of reversing switch 38 and therefore on the direction of the d-c heating current which can flow in the circuit between lines 15 and 16, one of the two filaments 11 and 12 is traversed by d-c current. Because of the fact that both heating filaments 11 and 12 have different lengths, two focus points of different sizes can be generated. The selection is made by switching reversing switch 38.

As in the embodiment of FIG. 3, in the embodiment of FIG. 4 either first heating filament 11 or second heating filament 12 or third heating filament 13 is under operation, i.e. will emit electrons.

Figure 5:
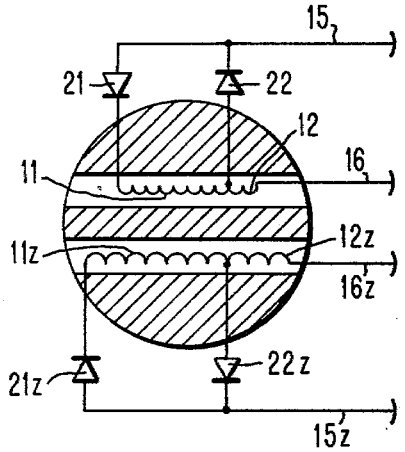
FIG. 5 is a top view of a cathode arrangement for a quadruple focus X-ray generator.

FIG. 5 shows still another embodiment. In this embodiment the third heating filament 13 of FIG. 2 is replaced by a filament combination **11*z*, 12*z* which is like the filament combination 11, 12. Thus, a tetrafocal X-ray tube can be obtained with two tapped heating coils. The lengths of two heating filaments 11, 12, 11*z***

12z may be such that 11 is longer than 12, the combination of 11 and 12 is longer than 12z, and the combination of 11z and 12z is longer than the combination of 11 and 12. To the left end of heating filament 11z is connected a diode 21z, and to the tap of filament combination 11z, 12z is connected a diode 22z. Anode of diode 21z and cathode of diode 22z are connected to a line 15. The free end of combination 11z, 12z is connected to a line 16z. It can be seen that the arrangement of diodes 21z and 22z and of heating filaments 11z and 12z corresponds to the arrangement of the parts 11, 12, 21,22. The arrangement 11z, 12z, 21z, 22z is supplied by a d-c source (not shown) via a further reversing switch (not shown).

The tetrafocal generator according to FIG. 5 requires only four energy supply lines 15, 16, 15z and 16z to control independently four focal points.

There has thus been shown and described a novel X-ray generator which fulfills all the objects and advantages sought therefore. Many changes, modifications, variations and other uses and applications of the subject invention will, however, become apparent to those skilled in the art after considering this specification and the accompanying drawings which disclose preferred embodiments thereof. All such changes, modifications, variations and other uses and applications which do not depart from the spirit and scope of the invention are deemed to be covered by the invention which is limited only by the claims which follow.

What is claimed is:

1. A multiple focus X-ray generator comprising, in combination:

(a) an electron source having at least a first and a second cathode filament, one end of each of said first and second filaments being connected together to a first connection point;

(b) a first, second and third terminal associated with the serial connection of said filaments, said first and third terminals being formed by the outer ends of the serial connection, and said second terminal being formed by said first connection point;

(c) a first and a second diode, each having two electrodes, the first diode being connected with one of its electrodes to said first terminal, the second diode being connected with one of its electrodes to said second terminal, said diodes being connected with the other of their electrodes to a second combination point and being poled in opposite directions;

(d) means for supplying direct current, said d-c supply means having two poles, one of said poles being adapted to be connected to said second connection point of said diodes and the other of said poles being adapted to be connected to said third terminal, and said d-c supply means including switching means for changing the polarity of the d-c voltage between said two poles; and (e) a cable containing at least a first and a second connection line, wherein said first connection line is arranged between said one pole of said d-c supply means and said second connection point, and wherein said second connection line is arranged between said other pole of said d-c supply means and said third terminal.

2. X-ray generator according to claim 1, further comprising a cathode head having a first groove, wherein said first and second filaments are arranged in said first groove and are electrically insulated from the head.

3. X-ray generator according to claim 1, wherein the first and the second filaments are the sections of a tapped heating coil.

4. X-ray generator according to claim 3, wherein both sections have substantially the same length.

5. X-ray generator according to claim 1, further comprising a third cathode filament which is connected to a terminal located at the outer end of said serial connection, said third filament being adapted to be connected to electrical supply means.

6. X-ray generator according to claim 5, wherein said electrical supply means is an a-c source.

7. X-ray generator according to claim 5, wherein the length of said third cathode filament is longer than the combined lengths of the first and second filaments.

8. X-ray generator according to claim 5, further comprising a cathode head having a second groove, and wherein said third cathode filament is arranged in said second groove and is electrically insulated from the head.

9. X-ray generator according to claim 5, wherein said terminal which is connected to said third filament, is connected to ground.

10. X-ray generator according to claim 9, wherein said terminal, which is connected to said third filament, is adapted for applying an anode-cathode-voltage thereto.

11. X-ray generator according to claim 5, further comprising a first switch for switching on and off said d-c supply means and a second switch for switching on and off said electrical supply means.

12. X-ray generator according to claim 11, wherein said first and said second switch are arranged remotely from said filaments.

* * * * *

UNITED STATES PATENT AND TRADEMARK OFFICE

CERTIFICATE OF CORRECTION

PATENT NO. : 4,266,133

DATED : May 5, 1981

INVENTOR(S) : Weigl et al.

It is certified that error appears in the above—identified patent and that said Letters Patent is hereby corrected as shown below:

Col. 9, lines 46 and 47, "combination" should read -connection-.

Signed and Sealed this

*Eighteenth* Day of *May 1982*

[SEAL]

*Attest:*

GERALD J. MOSSINGHOFF

*Attesting Officer*

*Commissioner of Patents and Trademarks*